US010499145B2

(12) United States Patent
Takemoto

(10) Patent No.: US 10,499,145 B2
(45) Date of Patent: Dec. 3, 2019

(54) SOUND PRESSURE GRADIENT MICROPHONE

(71) Applicant: Panasonic Intellectual Property Management Co., Ltd., Osaka (JP)

(72) Inventor: Makoto Takemoto, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/031,516

(22) Filed: Jul. 10, 2018

(65) Prior Publication Data

US 2018/0324522 A1 Nov. 8, 2018

Related U.S. Application Data

(63) Continuation of application No. PCT/JP2017/004853, filed on Feb. 10, 2017.

(30) Foreign Application Priority Data

Mar. 11, 2016 (JP) ..... 2016-048387

(51) Int. Cl.
*H04R 3/00* (2006.01)
*H04R 1/40* (2006.01)
(Continued)

(52) U.S. Cl.
CPC ..... *H04R 1/38* (2013.01); *H04R 1/222* (2013.01); *H04R 19/04* (2013.01); *H04R 3/005* (2013.01)

(58) Field of Classification Search
CPC ..... H04R 1/222; H04R 1/265; H04R 1/38; H04R 1/406; H04R 3/00; H04R 3/005; H04R 19/04; H04R 2430/23
(Continued)

(56) References Cited

U.S. PATENT DOCUMENTS 4,354,059 A * 10/1982 Ishigaki ..... H04R 3/005 381/103
5,193,117 A * 3/1993 Ono ..... H04R 3/005 381/92
(Continued)

FOREIGN PATENT DOCUMENTS

JP 5-347793 12/1993
JP 7-131886 5/1995

OTHER PUBLICATIONS

Yoshihiro Onishi, "Special Issue Electronic Circuit Analysis by Computer, Simulation of RCL Circuit, Basic of Passive Circuit and Analysis of Passive Circuit (Partial English Translation)", Transistor Gijutsu, Japan, CQ Publishing Co., Ltd., published Sep. 1996, vol. 33, No. 9, pp. 249-264.
(Continued)

*Primary Examiner* — Xu Mei
(74) *Attorney, Agent, or Firm* — Greenblum & Bernstein, P.L.C.

(57) ABSTRACT

A sound pressure gradient microphone includes: a first non-directional microphone; a second non-directional microphone; a delay device that receives an output of the second non-directional microphone; and a subtractor that receives an output of the first non-directional microphone and an output of the delay device. The subtractor outputs a difference between the output of the first non-directional microphone and the output of the delay device. A phase of the first non-directional microphone is ahead of a phase of the second non-directional microphone.

5 Claims, 10 Drawing Sheets

(51) Int. Cl.
*H04R 1/38* (2006.01)
*H04R 1/22* (2006.01)
*H04R 19/04* (2006.01)

(58) Field of Classification Search
USPC ..... 381/91, 92, 122, 97
See application file for complete search history.

(56) References Cited

U.S. PATENT DOCUMENTS

| | | | | | |
|---|---|---|---|---|---|
| 5,226,087 | A | | 7/1993 | Ono et al. | |
| 5,473,701 | A | * | 12/1995 | Cezanne | H04R 1/406 381/92 |
| 5,757,933 | A | * | 5/1998 | Preves | H04R 25/407 381/313 |
| 7,409,068 | B2 | * | 8/2008 | Ryan | H04R 1/08 381/313 |
| 7,945,056 | B2 | * | 5/2011 | Burger | H04R 25/405 381/122 |
| 8,340,316 | B2 | * | 12/2012 | Kanamori | H04R 3/005 381/122 |
| 8,638,955 | B2 | * | 1/2014 | Takano | H04R 1/04 381/122 |
| 2002/0034310 | A1 | * | 3/2002 | Hou | H04R 3/005 381/92 |

OTHER PUBLICATIONS

International Search Report of PCT application No. PCT/JP2017/004853 dated Apr. 25, 2017.

* cited by examiner

SOUND PRESSURE GRADIENT MICROPHONE

CROSS-REFERENCE TO RELATED APPLICATIONS

This application is a continuation of the PCT International Application No. PCT/JP2017/004853 filed on Feb. 10, 2017, which claims the benefit of foreign priority of Japanese patent application No. 2016-048387 filed on Mar. 11, 2016, the contents all of which are incorporated herein by reference.

BACKGROUND

1. Technical Field

The present disclosure relates to phase control of a sound pressure gradient microphone, and relates to a directional microphone for obtaining favorable frequency characteristics.

2. Description of the Related Art

There is known a sound pressure gradient microphone in which two or more microphone elements are provided and a distance between the respective microphone elements, and an amplitude, a phase, a delay amount, or the like at the time of signal synthesis are adjusted to obtain various directivity characteristics.

FIGS. 1A to 1D show examples of directivity characteristics of microphones. FIG. 1A shows non-directional characteristics, FIG. 1B shows bi-directional characteristics, FIG. 1C shows unidirectional characteristics, and FIG. 1D shows narrow-directional characteristics. It is desired that these directional characteristics are optimally selected for each sound pickup scene, in consideration of a position of a target to be picked up, or an unintended sound field.

Assumed that a microphone is positioned at the center point O, the line in FIGS. 1A to 1D indicates sensitivity [dB] to sound coming from each direction and having the same sound pressure. This represents that the sensitivity in a direction becomes more favorable, as an area from the center point O is larger in the direction. Note that, in the following description, a direction in which directivity characteristics have the highest sensitivity is referred to as "oriented direction."

FIG. 2 is a diagram showing an example of a configuration of a primary sound pressure gradient microphone. The primary sound pressure gradient microphone has non-directional microphones (hereinafter referred as microphones) 201 and 202, delay device 203, and subtractor 204.

The primary sound pressure gradient microphone is configured such that delay device 203 delays an output signal of microphone 202, which is disposed in a direction in which the sensitivity thereof is desirably lowered (for example, rearward), and subtractor 204 subtracts from an output signal of first non-directional microphone 201, which is disposed in a direction (for example, forward) in which the sensitivity thereof is desirably increased. An output signal from subtractor 204 is output as a sound pickup result of the primary sound pressure gradient microphone.

FIG. 3 is a diagram for explaining a principle of forming directivity by using the primary sound pressure gradient microphone.

FIG. 3 illustrates the state where sound waves travel along a direction of the arrow. Herein, the direction of the arrow corresponds to an oriented direction. In FIG. 3, microphones 201 and 202 are separated from each other by distance "d" and disposed on the same axis along the oriented direction.

Delay amount τ of delay device 203 is set to satisfy "τ=d/C" wherein sound velocity is C. By doing so, even if a sound wave comes from a direction opposite to the direction of the arrow, the timing at which an output signal is output from microphone 202 to subtractor 204 via delay device 203 can be matched with the timing at which the sound wave arrives at microphone 201. In other words, when a sound wave comes from a direction opposite to the direction of the arrow, the signal output from microphone 202 is input to subtractor 204 at the same timing as when the signal output from microphone 201 is input to subtractor 204, so that both signals are cancelled each other. In this way, the primary sound pressure gradient microphone forms blind spots in sensitivity, so that the sensitivity in an intended direction is relatively increased to achieve directivity.

FIG. 4 is a diagram for explaining a method of deriving directivity characteristics in a primary sound pressure gradient microphone.

The sound entering at incident angle θ with respect to the oriented direction (the direction of the arrow) causes a delay difference of d·cos θ/C between microphones 201 and 202. Furthermore, delay device 203 delays the signal output from microphone 202 by τ. Therefore, the signal output from microphone 202 to subtractor 204 is delayed by d·cos θ/C+τ with respect to the signal output from microphone 201 to subtractor 204.

Accordingly, the output of subtractor 204 is expressed by the following equation (1).

$$e^{-j\omega t} - e^{-j\omega\left(t-\frac{d\cos\theta}{C}-\tau\right)} = e^{-j\omega t}\{1 - e^{j\omega\tau(1+\cos\theta)}\} \tag{1}$$

Then, directivity characteristics for directivity angle θ can be represented as FIG. 5, based on equation (1). Note that, in FIG. 5, like FIGS. 3 and 4, the direction of the arrow is indicated as the oriented direction. Microphone 201 and 202 are arranged along a direction directed by the arrow.

Meanwhile, expression (1) is based on the assumption that microphones 201 and 202 have the same characteristics. In other words, in equation (1), an output of subtractor 204 is obtained based on the assumption that, when sound waves generated from the same sound source arrive at the same timing, an output signal generated by microphone 201 will have the same gain as an output signal generated by microphone 202 and no phase difference will occur between both output signals.

However, since actual microphone elements have characteristic variations individually, the above-mentioned output is deviated from a theoretical value of the above equation. In view of this, Unexamined Japanese Patent Publication No. H07-131886 focuses on variations in gain of two non-directional microphones and provides ways for correcting the variations.

SUMMARY

The present disclosure relates to phase control of a sound pressure gradient microphone and aims to provide favorable frequency characteristics.

The present disclosure also aims to achieve a state where a phase of a microphone located closer to a sound wave coming from an oriented direction of a sound pressure gradient microphone is ahead of a phase of a microphone located far from the sound wave coming from the oriented direction.

A main aspect of the present disclosure is a sound pressure gradient microphone that includes a first non-directional microphone, a second non-directional microphone, a delay device that receives an output of the second non-directional microphone, and a subtractor that receives an output of the first non-directional microphone and an output of the delay device. The subtractor outputs a difference between the output of the first non-directional microphone and the output of the delay device. A phase of the first non-directional microphone is ahead of a phase of the second non-directional microphone.

Further, a sound pressure gradient microphone in accordance with another aspect of the present disclosure includes a first non-directional microphone, a second non-directional microphone, a first high-pass filter that receives an output of the first non-directional microphone, a second high-pass filter that receives an output of the second non-directional microphone, a delay device that receives an output of the second high-pass filter, and a subtractor that receives an output of the first high-pass filter and an output of the delay device. The subtractor outputs a difference between the output of the first high-pass filter and the output of the delay device. The first high-pass filter has a first capacitor connected in series with the first non-directional microphone and the subtractor between the first non-directional microphone and the subtractor. The second high-pass filter has a second capacitor connected in series with the second non-directional microphone and the delay device between the second non-directional microphone and the delay device. The first capacitor has a capacitance value smaller than a capacitance value of the second capacitor so as to achieve a state where a phase of a signal output from the first high-pass filter is ahead of a phase of a signal output from the second high-pass filter.

Moreover, a sound pressure gradient microphone in accordance with still another aspect of the present disclosure includes a first non-directional microphone, a second non-directional microphone, a first high-pass filter that receives an output of the first non-directional microphone, a second high-pass filter that receives an output of the second non-directional microphone, a delay device that receives an output of the second high-pass filter, and a subtractor that receives an output of the first high-pass filter and an output of the delay device. The subtractor outputs a difference between the output of the first high-pass filter and the output of the delay device. The first high-pass filter includes a first capacitor and a first resistor. The first capacitor is connected in series with the first non-directional microphone and the subtractor between the first non-directional microphone and the subtractor. The first resistor has a grounded first end and a second end connected to a line between the first non-directional microphone and the subtractor. The second high-pass filter includes a second capacitor and a second resistor. The second capacitor is connected in series to the second non-directional microphone and the delay device between the second non-directional microphone and the delay device and. The second resistor has a grounded first end and a second end connected to a line between the second non-directional microphone and the delay device. The first resister has a resistance value smaller than a resistance value of the second resistor so as to achieve the state where a phase of a signal output from the first high-pass filter is ahead of a phase of a signal output from the second high-pass filter.

Furthermore, a sound pressure gradient microphone in accordance with yet another aspect of the present disclosure includes a first non-directional microphone, a second non-directional microphone, a first digital filter that receives an output of the first non-directional microphone, a second digital filter that receives an output of the second non-directional microphone, a delay device that receives an output of the second high-pass filter, and a subtractor that receives an output of the first digital filter and an output of the delay device. The subtractor outputs a difference between the output of the first digital filter and the output of the delay device. The first and second digital filters are set so as to achieve a state where a phase of a signal output from the first digital filter is ahead of a phase of a signal output from the second digital filter.

According to the present disclosure, a sound pressure gradient microphone with favorable frequency characteristics can be obtained, i.e., a drop in sound pressure gradient output, so-called Dip, does not occur in frequency characteristics of a microphone.

DETAILED DESCRIPTION OF PREFERRED EMBODIMENTS

Prior to description of embodiments of the disclosure, problems in the conventional technology will be described. A non-directional microphone produces variations not only in gain but also in phase. For a waveform of a sound wave, a phase delay and a phase advance (hereinafter, referred to as "a phase of a non-directional microphone") of signals output from microphone 201 and 202 are defined by α and β, respectively. When equation (1) is rewritten, following equation (2) is obtained.

$$e^{-j(\omega t+\alpha)} - e^{-j\left\{\omega\left(t-\frac{d\cos\theta}{C}-\tau\right)+\beta\right\}} = e^{-j\omega t}\{e^{-j\alpha} - e^{-j(\beta-\omega\tau(1+\cos\theta))}\} \quad (2)$$

Figure 1A:
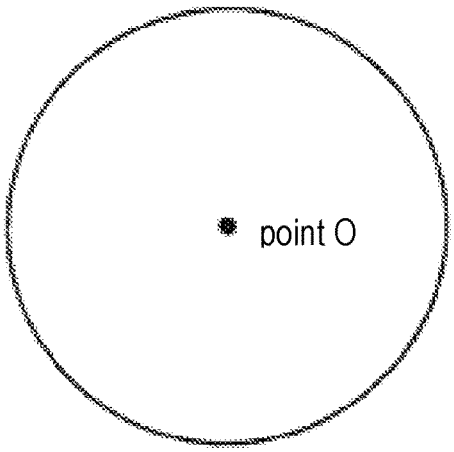
FIG. 1A is a diagram showing an example of directivity characteristics of a non-directional microphone.
Figure 1B:
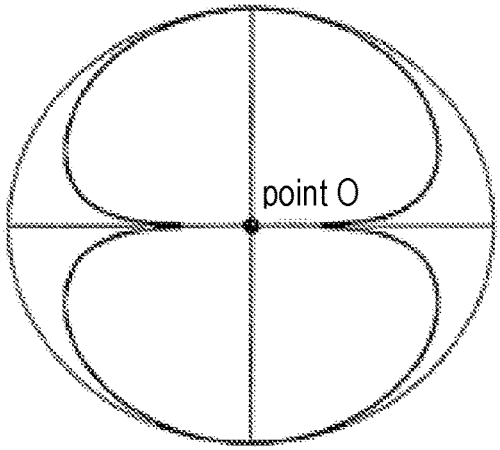
FIG. 1B is a diagram showing an example of directivity characteristics of a bi-directional microphone.
Figure 1C:
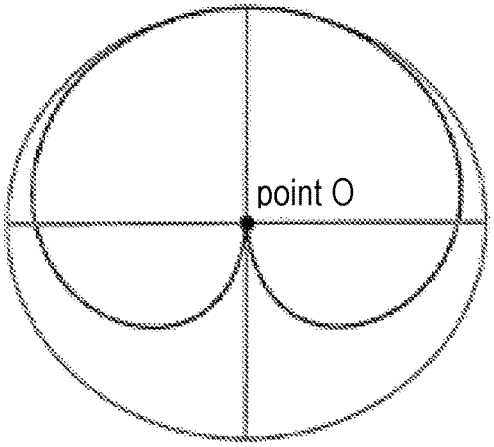
FIG. 1C is a diagram showing an example of directivity characteristics of a unidirectional microphone.
Figure 1D:
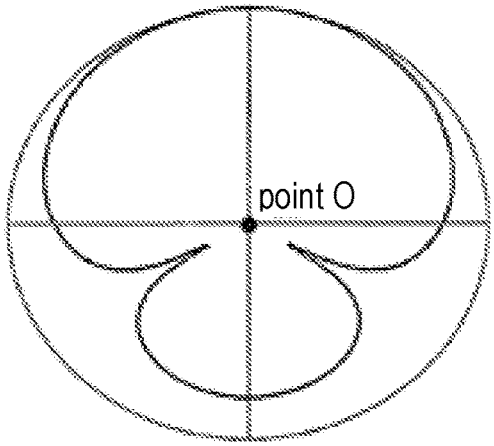
FIG. 1D is a diagram showing an example of directivity characteristics of a narrow-directional microphone.
Figure 2:
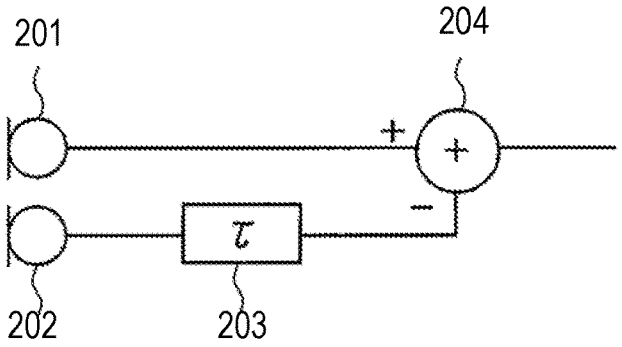
FIG. 2 PRIOR ART
FIG. 2 is a diagram showing an example of a configuration of a sound pressure gradient microphone.
Figure 3:
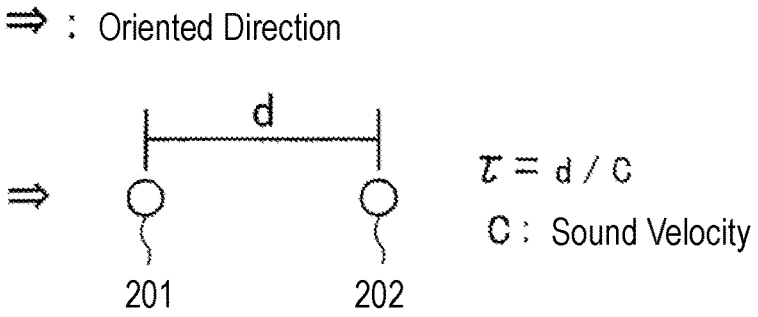
FIG. 3 PRIOR ART
FIG. 3 is a diagram for explaining a principle of forming directivity by using a primary sound pressure gradient microphone.
Figure 4:
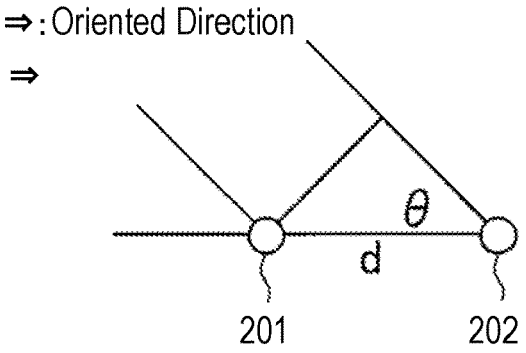
FIG. 4 PRIOR ART
FIG. 4 is a diagram for explaining a method of deriving directivity characteristics in a primary sound pressure gradient microphone.

Hereinafter, for convenience, a microphone located closer to a sound wave coming from the oriented direction is referred to as "a front microphone," and a microphone located far from the sound wave is referred to as "a rear microphone." In FIGS. 3 and 4, microphone 201 corresponds to the front microphone, and microphone 202 corresponds to the rear microphone.

Now, changes in sound pressure gradient output, which are caused by phase characteristics of microphones 201 and 202, will be described with reference to FIGS. 6 to 9.

Figure 6:
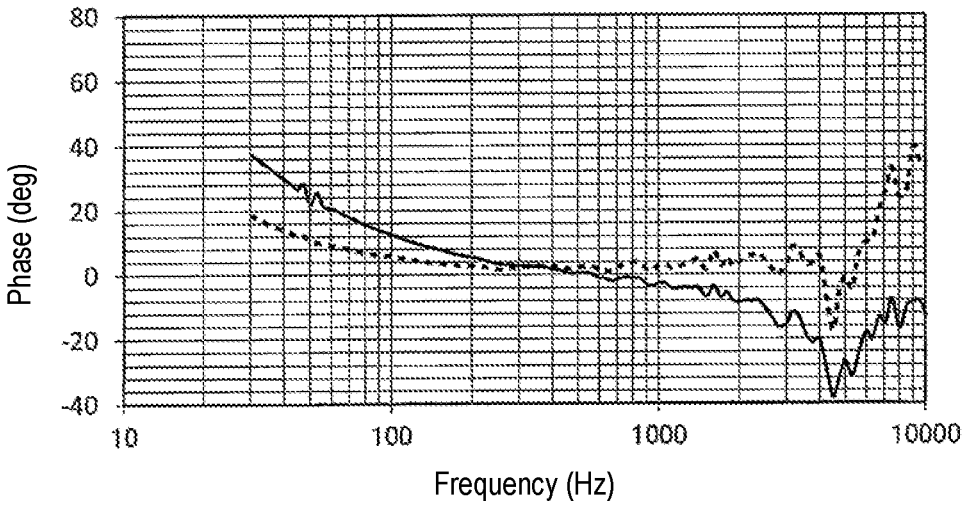
FIG. 6 is a diagram showing an example of phase vs. frequency characteristics of two non-directional microphones in a sound pressure gradient microphone.

FIG. 6 is a diagram showing an example of phase vs. frequency characteristics of microphone (front microphone) 201 and microphone (rear microphone) 202. The solid line represents the characteristics of microphone 201, and the broken line represents the characteristics of microphone 202. The vertical axis in FIG. 6 represents a phase advance angle and a phase delay angle according to frequency of an acoustic wave, which is obtained by actual measurement. In FIG. 6, at a frequency of approximately 300 Hz or less, phase α of microphone (front microphone) 201 is advanced from phase β of microphone (rear microphone) 202, i.e., the state (α>β) is obtained.

Figure 7:
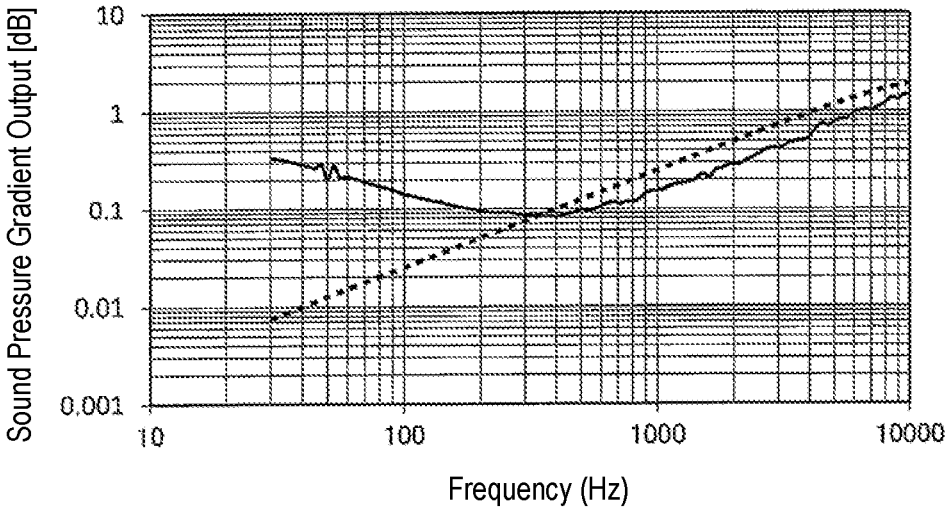
FIG. 7 is a diagram showing sound pressure gradient output of the sound pressure gradient microphone shown in FIG. 6.

FIG. 7 is a diagram showing sound pressure gradient output vs. frequency characteristics in a primary sound pressure gradient microphone. The vertical axis in FIG. 7 denotes a signal (sound pressure gradient output) [dB] outputted from subtractor 204, and represents output characteristics according to frequency of the sound wave.

The solid line (actually measured value) in FIG. 7 indicates front sensitivity, i.e., sound pressure gradient output vs. frequency characteristics at θ=0, in the case where microphone (front microphone) 201 and microphone (rear microphone) 202 having characteristics shown in FIG. 6 are used to constitute a primary sound pressure gradient microphone. To obtain the sound pressure gradient output vs. frequency characteristics, the measured values of the phase vs. frequency characteristics shown in FIG. 6 are substituted into equation (2).

Further, the broken line (theoretical value) in FIG. 7 represents sound pressure gradient output vs. frequency characteristics obtained from the theoretical expression (expression (1)) on the assumption that a phase difference between microphone (front microphone) 201 and microphone (rear microphone) 202 is zero.

In FIG. 7, at a frequency of approximately 300 Hz or less, the sound pressure gradient output starts deviating from the theoretical value due to the phase difference. However, serious problems will not occur in practical use, because an equalizer, a high pass filter (HPF) (neither shown), or the like may be provided in the latter stage of the sound pressure gradient output to cut a low frequency of 100 Hz or less.

Next, in the case where microphone 201 and microphone 202 are exchanged in characteristics, a change in sound pressure gradient output will be explained.

Figure 8:
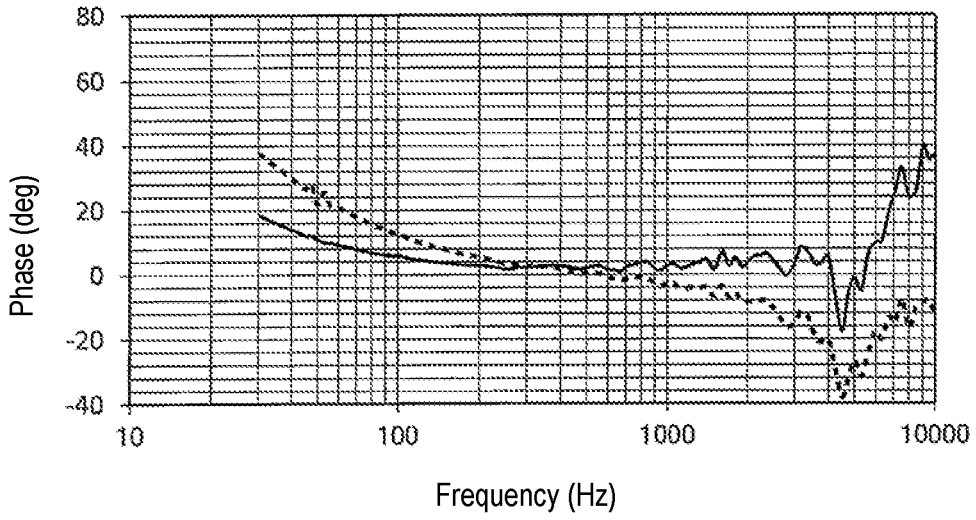
FIG. 8 is a diagram showing another example of phase vs. frequency characteristics of two non-directional microphones in a sound pressure gradient microphone.

FIG. 8 is a diagram showing an example of phase vs. frequency characteristics of microphone (front microphone) 201 and microphone (rear microphone) 202 in this case. The solid line represents the characteristics of microphone 201, and the broken line represents the characteristics of microphone 202. FIG. 8 shows a state (α<β) where phase α of microphone (front microphone) 201 is delayed from phase β of microphone (rear microphone) 202 at a frequency of approximately 300 Hz or less.

Figure 9:
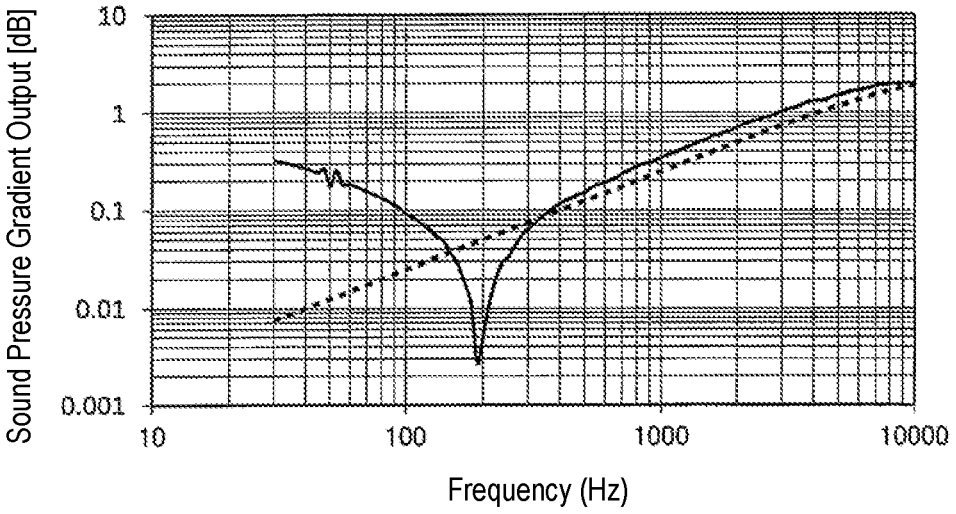
FIG. 9 is a diagram showing sound pressure gradient output of the sound pressure gradient microphone shown in FIG. 8.

Similarly to FIG. 7, the solid line (actually measured value) in FIG. 9 represents sound pressure gradient output vs. frequency characteristics obtained by substituting the phase vs. frequency characteristics shown in FIG. 8 into expression (2). Further, similarly to FIG. 7, the broken line (theoretical value) in FIG. 9 represents sound pressure gradient output vs. frequency characteristics obtained from the theoretical expression (equation (1)) on the assumption that a phase difference between microphone (front microphone) 201 and microphone (rear microphone) 202 is zero.

In FIG. 9, a drop in sound pressure gradient output (also referred to as "Dip") occurs near 200 Hz. The drop in sound pressure gradient output occurs in a sound wave whose frequency makes the value of equation (2) zero.

The above-mentioned situation will be described with reference to the following expressions (3) and (4). The value of equation (2) is zero when the frequency satisfies equality in equation (3).

$$\alpha=\beta-\omega\tau(1+\cos\theta) \quad (3)$$

Equation (3) can be expressed as equation (4) through formula conversion.

$$\omega\tau+(1+\cos\theta)=\beta-\alpha \quad (4)$$

Herein, at a frequency of 300 Hz or less, the state (α<β) is established, i.e., phase α of microphone (front microphone) 201 is delayed from phase β of microphone (rear microphone) 202. Therefore, β−α>0 is satisfied, so that ω for holding expressions (3) and (4) is present.

Note that, as described above, the sound pressure gradient microphone forms directivity using a phase difference between two points in a space. Accordingly, as shown by the solid line in FIG. 9, in a low frequency band satisfying ωτ<<1, sound pressure gradient output decreases at 6 dB/octave as the frequency decreases. In view of the above, an equalizer (not shown) or the like is typically provided in the latter stage of a sound pressure gradient microphone. The sound pressure gradient output is adjusted by the equalizer such that the sound pressure gradient output vs. frequency characteristics draw a flat characteristic curve. However, in the case where the drop occurs in the sound pressure gradient output vs. frequency characteristics as shown in FIG. 9, it will be difficult to correct the sound pressure gradient output vs. frequency characteristics, even if an equalizer or the like is provided. Therefore, flatness of the sound pressure gradient output vs. frequency characteristic is impaired.

In other words, if the phase of microphone (front microphone) 201 is delayed from the phase of microphone (rear microphone) 202, Dip will occur. This causes a situation where favorable sound pressure gradient output vs. frequency characteristics are difficult to ensure. When the phase of microphone (front microphone) 201 is delayed from the phase of microphone (rear microphone) 202 in the low frequency band (for example, 300 Hz or lower), the Dip, mentioned above, is mainly occurred.

Furthermore, the frequency, which causes the drop in FIG. 9, varies depending on individual phase vs. frequency characteristics of microphones 201 and 202, and the combination thereof, and takes various values. Hereinafter, exemplary embodiments of the present disclosure will be described.

First Exemplary Embodiment

Figure 10:
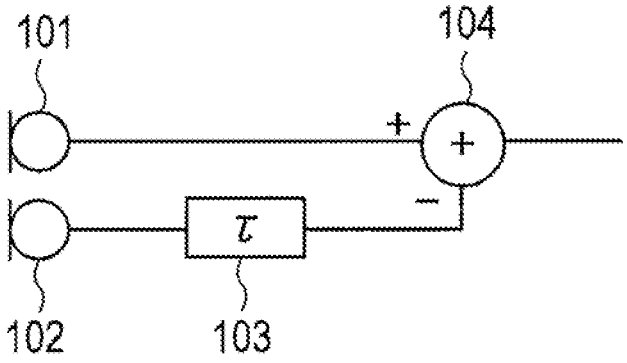
FIG. 10 is a diagram showing an example of a configuration of a sound pressure gradient microphone in accordance with a first exemplary embodiment.

FIG. 10 is a diagram showing an example of a configuration of a sound pressure gradient microphone in accordance with a first exemplary embodiment.

The sound pressure gradient microphone in accordance with the present embodiment is configured to include first non-directional microphone 101, second non-directional microphone 102, delay device 103, and subtractor 104. These signal processing paths are the same as those described above with reference to FIG. 1.

First non-directional microphone (hereinafter referred as microphone) 101 picks up incoming sound waves, generates a first output signal, and outputs it to a plus (+) side input terminal of subtractor 104. Second non-directional microphone (hereinafter referred as microphone) 102 picks up incoming sound waves, generates a second output signal, and outputs it to delay device 103. Note that, microphones 101 and 102 are microphone elements whose sensitivities are approximately equal in all directions of 360 degrees, but if a sound pressure gradient microphone can be configured by using them, their sensitivities may be somewhat distorted, of course as well as they can make up a sound pressure gradient microphone.

Figure 5:
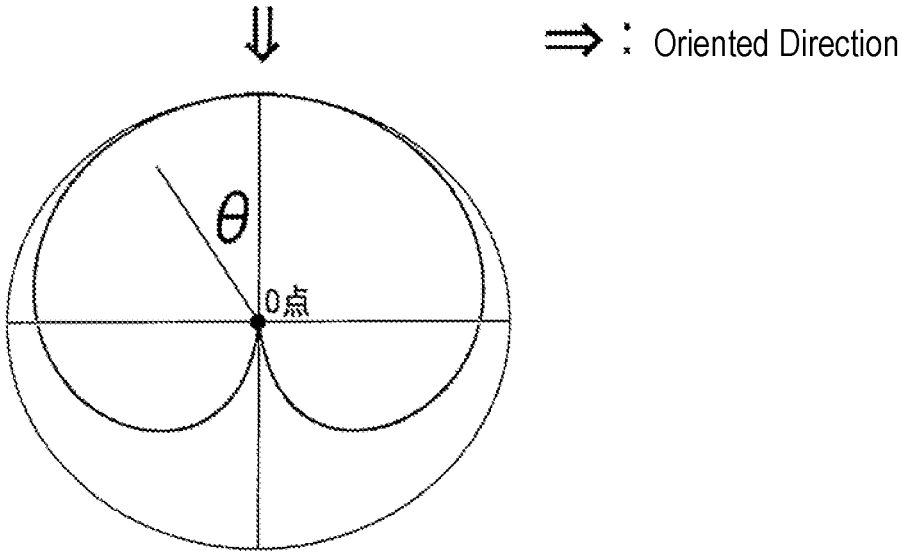
FIG. 5 PRIOR ART
FIG. 5 is a diagram showing directivity characteristics of the sound pressure gradient microphone shown in FIG. 2.

Delay device 103 delays the second output signal input from second non-directional microphone 102 by $\tau$, and outputs it to a minus (−) side input terminal of subtractor 104. To achieve the directivity characteristics shown in FIG. 5, delay amount $\tau$ of delay device 103 is set to be $\tau=d/C$. Note that, d denotes a distance between microphones 101 and 102, and C denotes sound velocity.

Subtractor 104 subtracts the second output signal, which is delayed by delay device 103, from the first output signal of microphone 101 and outputs the resulting signal as a difference signal.

Note that, in the sound pressure gradient microphone in accordance with the present embodiment, phase vs. frequency characteristics of a plurality of non-directional microphones are measured in advance. Then, microphones 101 and 102 are selected form the plurality of non-directional microphones, and are arranged to achieve a state where a phase of microphone 101 is ahead of a phase of microphone 102. To achieve such a state, microphones 101 and 102 are arranged such that values $\alpha$ and $\beta$ in expression (2) satisfy the relation of "$\alpha>\beta$", for example.

As mentioned above, according to the characteristics of the sound pressure gradient, in the case where the phase of microphone 101 is ahead of the phase of microphone 102, a drop in amplitude (Dip) on a frequency axis does not occur (see FIGS. 6 and 7).

As mentioned above, the sound pressure gradient microphone in accordance with the present exemplary embodiment can obtain favorable frequency characteristics in which a drop in amplitude, so-called Dip, does not occur, while ensuring desired directivity characteristics.

Second Exemplary Embodiment

Figure 11:
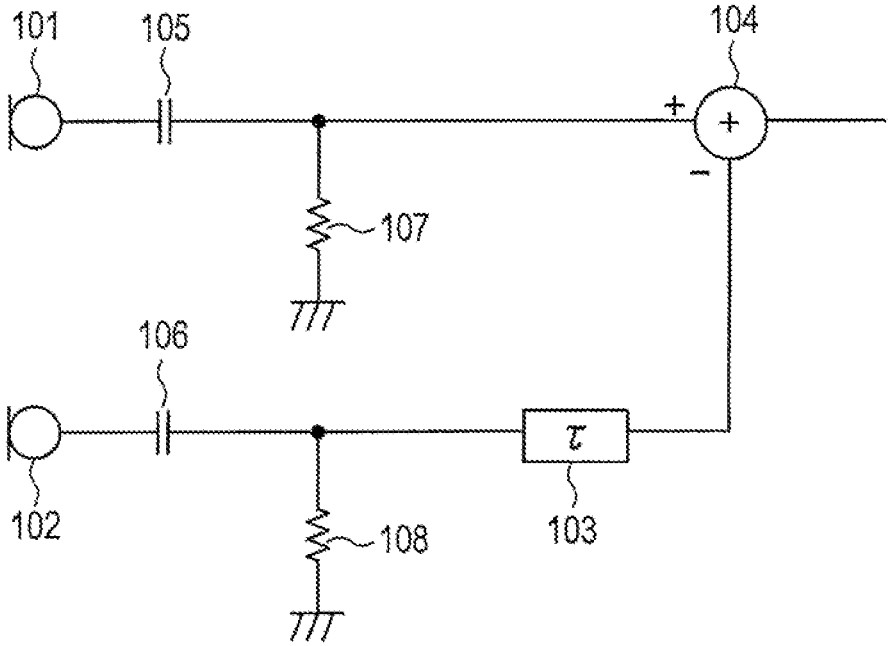
FIG. 11 is a diagram showing an example of a configuration of a sound pressure gradient microphone in accordance with a second exemplary embodiment.

FIG. 11 is a diagram showing an example of a configuration of a sound pressure gradient microphone in accordance with a second exemplary embodiment.

The sound pressure gradient microphone in accordance with the present exemplary embodiment is different from the sound pressure gradient microphone in accordance with the first exemplary embodiment in that a first HPF (high-pass filter) and a second HPF are further provided in the corresponding one of the latter stages of first non-directional microphone 101 and second non-directional microphone 102. The first HPF includes first capacitor 105 and first resistor 107. The second HPF includes second capacitor 106 and second resistor 108. Since the other configurations are the same as those of the sound pressure gradient microphone in accordance with the first exemplary embodiment, the description thereof is omitted here (hereinafter, the same manner applies to other exemplary embodiments as well).

One end of first capacitor 105 is connected to an output side of microphone 101, and the other end thereof is connected to a plus side input terminal of subtractor 104. Further, first resistor 107 having one grounded end is connected to the other end of first capacitor 105 in parallel with a subtractor 104 side. In this way, the first HPF is constituted by first capacitor 105 connected in series between an input side and an output side, and first resistor 107 connected in parallel with the output side. In other words, first capacitor 105 is connected in parallel to microphone 101 and subtractor 104 therebetween. First resistor 107 has a grounded first end and a second end connected to a line between microphone 101 and subtractor 104.

One end of second capacitor 106 is connected to an output side of microphone 102, and the other end thereof is connected to an input terminal of delay device 103. Further, second resistor 108 having one grounded end is connected to the other end of second capacitor 106 in parallel with a delay device 103 side. In this way, the second HPF is constituted by second capacitor 106 connected in series between an input side and an output side, and second resistor 108 connected in parallel with the output side. In other words, second capacitor 106 is connected in parallel to microphone 102 and delay device 103 therebetween. Second resistor 108 has a grounded first end and a second end connected to a line between microphone 102 and delay device 103.

A first output signal of microphone 101 is input to the plus side input terminal of subtractor 104 via first capacitor 105. Further, a second output signal of microphone 102 is input to a minus side input terminal of subtractor 104 via second capacitor 106 and delay device 103. Subtractor 104 subtracts the second output signal from the first output signal and outputs the resulting signal as a difference.

Figure 12:
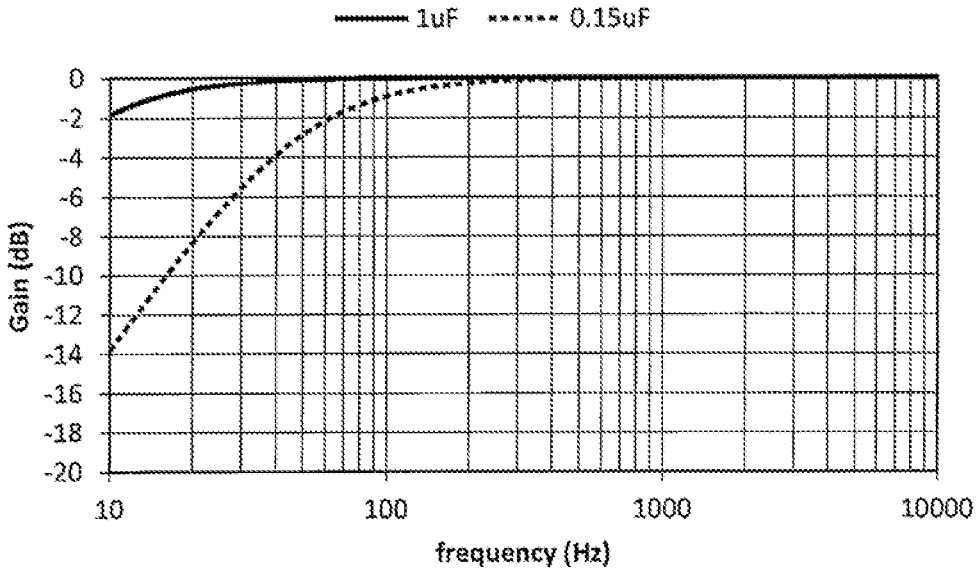
FIG. 12 is a diagram showing an example of gain characteristics of a high-pass filter formed in the second exemplary embodiment.
Figure 13:
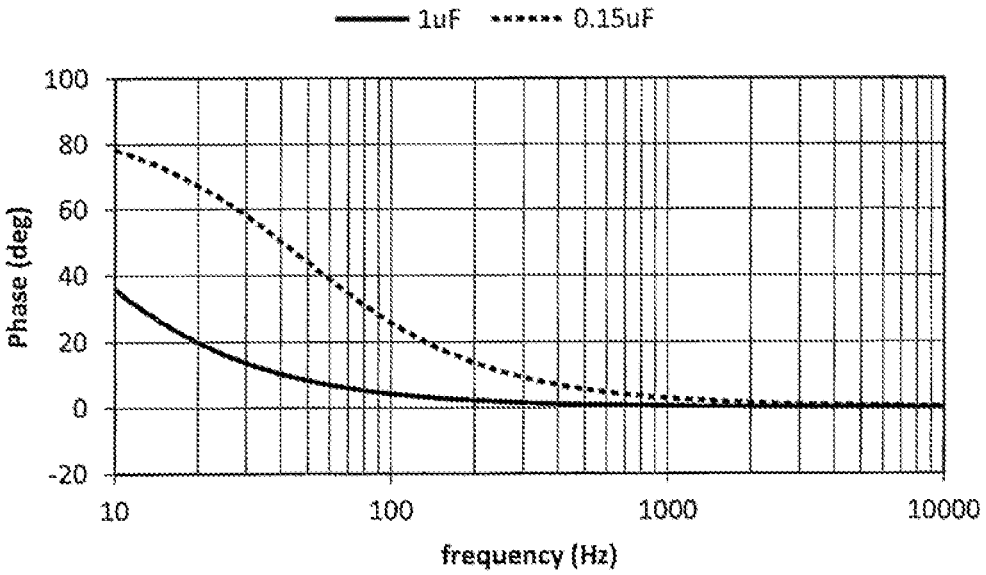
FIG. 13 is a diagram showing an example of phase characteristics of the high-pass filter formed in the second exemplary embodiment.

FIGS. 12 and 13 are diagrams showing gain characteristics and phase characteristics of the first HPF constituted by first capacitor 105 and first resistor 107, and the second HPF constituted by second capacitor 106 and second resistor 108, respectively. Herein, as an example, the resistance values of first resistor 107 and second resistor 108 are set to be 22 kΩ, the capacitance value of first capacitor 105 is set to be 0.15 μF, and the capacitance value of second capacitor 106 is set to be 1 μF. Accordingly, the solid line in each of FIGS. 12 and 13 represents the characteristics of the second HPF, and the broken line represents the characteristics of the first HPF.

As shown in FIG. 13, the first HPF and the second HPF ensure the phase advance in a low frequency region. At this time, the capacitance value of first capacitor 105 is made smaller than the capacitance value of second capacitor 106. This makes it possible to achieve a state where a phase of an output signal of the first HPF is ahead of a phase of an output signal of the second HPF in the low frequency region.

In other words, a phase difference between microphones 101 and 102 is absorbed by the phase difference between the HPFs. Therefore, the phase of the signal output from the first HPF is ahead of the phase of the signal output from the second HPF, constantly. In this case, the characteristics of sound pressure gradient does not cause a drop in amplitude (Dip) on the frequency axis, as described above.

Further, as shown in FIG. 12, the first HPF and the second HPF reduces a gain of signals having a low frequency region of 20 Hz or less. Typically, an audio band ranges from approximately 20 Hz to 20 kHz. Accordingly, if signals with a frequency of 20 Hz or less are mixed, low frequency distortion may be occurred. The first HPF and the second HPF also prevent the occurrence of such low frequency distortion.

As described above, the sound pressure gradient microphone in accordance with the present exemplary embodiment can obtain favorable frequency characteristics in which a drop in amplitude, so-called Dip, does not occur, while ensuring desired directivity characteristics.

Third Exemplary Embodiment

Figure 14:
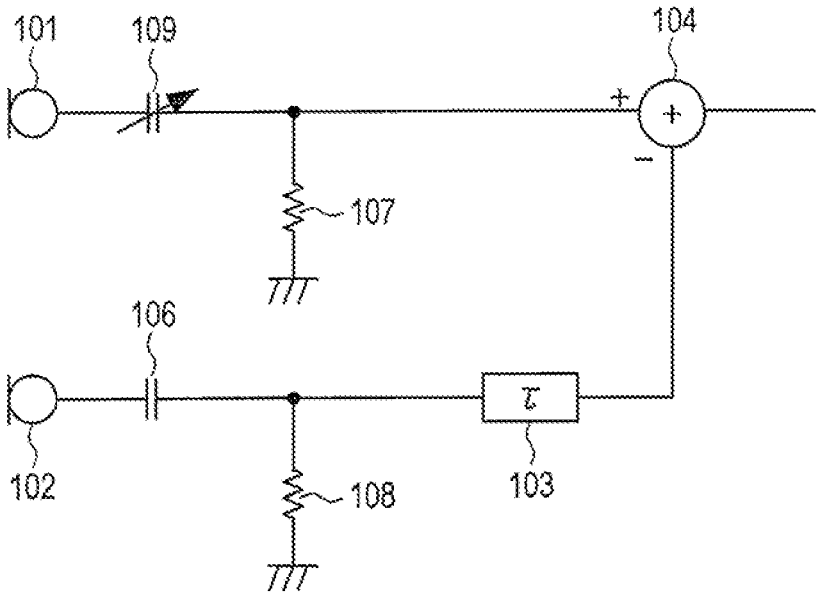
FIG. 14 is a diagram showing an example of a configuration of a sound pressure gradient microphone in accordance with a third exemplary embodiment.

FIG. 14 is a diagram showing an example of a configuration of a sound pressure gradient microphone in accordance with a third exemplary embodiment.

The sound pressure gradient microphone in accordance with the present exemplary embodiment is different from the sound pressure gradient microphone in accordance with the second exemplary embodiment in that first capacitor 105 is constituted by variable capacitor 109.

A first HPF constituted by variable capacitor 109 and first resistor 107 is provided in the latter stage of microphone 101. A second HPF constituted by second capacitor 106 and second resistor 108 is provided in the latter stage of microphone 102. Furthermore, in a signal path on which microphone 102 is provided, delay device 103 is provided in the latter stage of the second HPF. Subtractor 104 outputs a difference between an output signal from the first HPF, which is constituted by variable capacitor 109 and first resistor 107, and an output signal from delay device 103.

In the present exemplary embodiment, a capacitance value of variable capacitor 109 is made smaller than a capacitance value of second capacitor 106. Thereby, a phase of a signal output from the first HPF is ahead of a phase of a signal output from the second HPF. In other words, like the second exemplary embodiment, a phase difference between microphones 101 and 102 can be absorbed by a phase difference between the first HPF and the second HPF.

In this case, the characteristics of sound pressure gradient do not cause a drop in amplitude (Dip) on the frequency axis, as described above. In addition, variable capacitor 109 is allowed to adjust the phase characteristics of the signal output from the first HPF individually, so that a sound pressure gradient approximate to a theoretical value can be obtained.

As described above, the sound pressure gradient microphone in accordance with the present exemplary embodiment can obtain favorable frequency characteristics in which a drop in amplitude, so-called Dip, does not occur, while ensuring desired directivity characteristics.

Note that, in the present exemplary embodiment, first capacitor 105 is constituted by variable capacitor 109, but not limited to this. Second capacitor 106 may be constituted by a variable capacitor. Both the first and second capacitors may be constituted by variable capacitors.

Fourth Exemplary Embodiment

Figure 15:
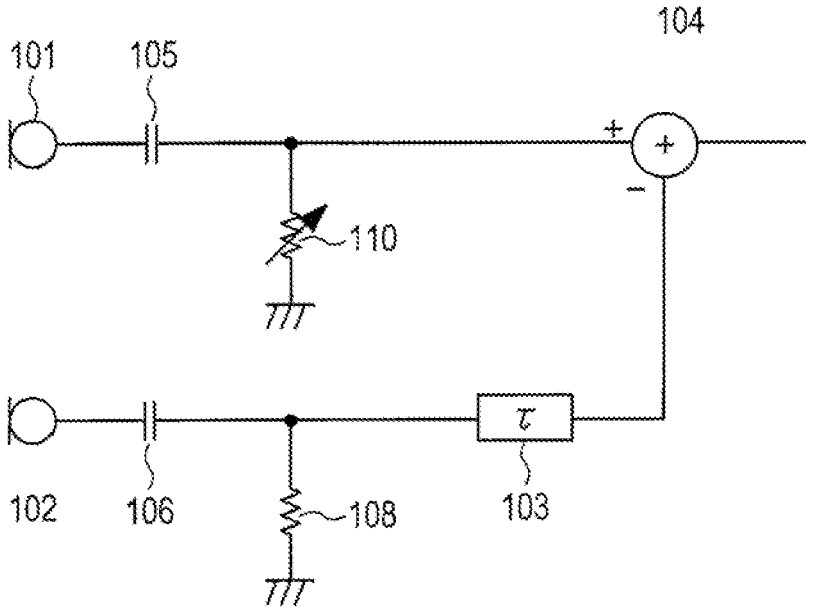
FIG. 15 is a diagram showing an example of a configuration of a sound pressure gradient microphone in accordance with a fourth exemplary embodiment.

FIG. 15 is a diagram showing an example of a configuration of a sound pressure gradient microphone in accordance with a fourth embodiment.

The sound pressure gradient microphone in accordance with the present exemplary embodiment is different from the sound pressure gradient microphone in accordance with the second exemplary embodiment in that first resistor 107 is constituted by variable resistor 110.

A first HPF constituted by first capacitor 105 and variable resistor 110 is provided in the latter stage of microphone 101. A second HPF constituted by second capacitor 106 and second resistor 108 is provided in latter stage of microphone 102. Furthermore, in a signal path on which second non-directional microphone 102 is provided, delay device 103 is provided in the latter stage of the second HPF.

Subtractor 104 outputs a difference between an output of the first HPF, which is constituted by first capacitor 105 and variable resistor 110, and an output of delay device 103.

In the present exemplary embodiment, a resistance value of variable resistor 110 is made smaller than a resistance value of second resistor 108. This makes it possible to achieve a state where a phase of a signal output from the first HPF is ahead of a phase of a signal output from the second HPF. In other words, a phase difference between microphones 101 and 102 can be absorbed by a phase difference between the first HPF and the second HPF.

In this case, the characteristics of sound pressure gradient do not cause a drop in amplitude (Dip) on the frequency axis, as described above. Further, variable resistor 110 is allowed to adjust the phase characteristics of the signal output from the first HPF individually, so that a sound pressure gradient approximate to a theoretical value can be obtained.

As described above, the sound pressure gradient microphone in accordance with the present exemplary embodiment can obtain favorable frequency characteristics in which a drop in amplitude, so-called Dip, does not occur, while ensuring desired directivity characteristics.

Note that, the exemplary embodiment shows that first resistor 107 is constituted by variable resistor 110, but not limited to this. Second resistor 108 may be constituted by a variable resistor. Both the first and second resistors may be constituted by variable resistors. In addition, in the constitution shown in FIG. 11, a resistance value of first resistor 107 may be smaller than a resistance value of second resistor 108.

Fifth Exemplary Embodiment

Figure 16:
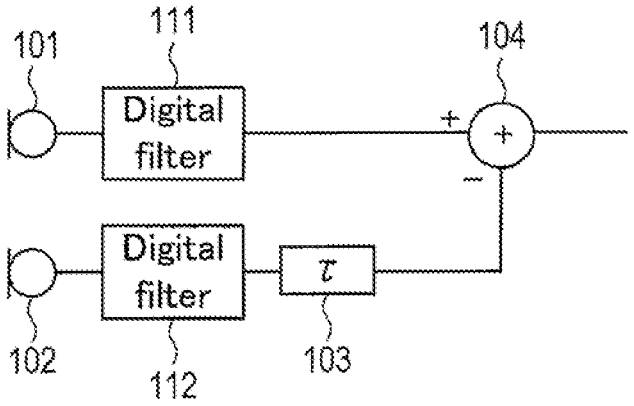
FIG. 16 is a diagram showing an example of a configuration of a sound pressure gradient microphone in accordance with a fifth exemplary embodiment.

FIG. 16 is a diagram showing an example of a configuration of a sound pressure gradient microphone in accordance with a fifth embodiment.

The sound pressure gradient microphone in accordance with the present exemplary embodiment is different from the sound pressure gradient microphone in accordance with the second exemplary embodiment in that a first HPF and a second HPF are constituted by first digital filter 111 and second digital filter 112, respectively.

First digital filter 111 is provided in the latter stage of microphone 101 which outputs digital signals. Second digital filter 112 is provided in the latter stage of microphone 102 which outputs digital signals. Furthermore, in a signal path on which second non-directional microphone 102 is provided, delay device 103 is provided in the latter state of second digital filter 112. Subtractor 104 outputs a difference between an output of first digital filter 111 and an output of delay device 103. Note that, each of first digital filter 111 and second digital filter 112 is, for example, an FIR (Finite Impulse Response) filter or an IIR (Infinite Impulse Response) filter.

First digital filter 111 and second digital filter 112 are adjusted so as to have, for example, the gain characteristics and the phase characteristics of the first HPF and the second HPF shown in FIGS. 12 and 13. In other words, in a low frequency region, an output phase of first digital filter 111 is ahead of an output phase of second digital filter 112. Accordingly, a phase difference between microphones 101 and 102 can be absorbed by a phase difference between first digital filter 111 and second digital filter 112.

In this case, the characteristics of sound pressure gradient do not cause a drop in amplitude (Dip) on the frequency axis, as described above. Further, first digital filter 111 and second digital filter 112 are allowed to adjust the phases individually, so that a sound pressure gradient approximate to a theoretical value can be obtained.

As described above, the sound pressure gradient microphone in accordance with the present exemplary embodiment can obtain favorable frequency characteristics in which a drop in amplitude, so-called Dip, does not occur, while ensuring desired directivity characteristics.

Note that, the above-mentioned exemplary embodiments show that two non-directional microphones are used as an example of a configuration of the sound pressure gradient microphone, but not limited to this. Three or more non-directional microphones may be used depending on required directivity characteristics.

As mentioned above, specific examples of the present disclosure have been described in detail, but these are merely examples and do not intended to limit the scope of the claims. Techniques described in the claims include those in which the concrete examples exemplified above are variously modified and changed.

The present disclosure is applicable to a sound pressure gradient microphone used as one of directional microphones, and phase control of the sound pressure gradient microphone.

What is claimed is:

1. A sound pressure gradient microphone, comprising:

a first non-directional microphone;

a second non-directional microphone;

a first high-pass filter that receives an output of the first non-directional microphone;

a second high-pass filter that receives an output of the second non-directional microphone;

a delay device that receives an output of the second high-pass filter; and a subtractor that receives an output of the first high-pass filter and an output of the delay device, and outputs a difference between the output of the first high-pass filter and the output of the delay device, wherein the first high-pass filter includes a first capacitor, which is disposed between the first non-directional microphone and the subtractor, and is connected in series to the first non-directional microphone and the subtractor, the second high-pass filter includes a second capacitor, which is disposed between the second non-directional microphone and the delay device, and is connected in series to the second non-directional microphone and the delay device, and a capacitance value of the first capacitor is smaller than a capacitance value of the second capacitor so as to achieve a state where a phase of a signal output from the first high-pass filter is ahead of a phase of a signal output from the second high-pass filter.

2. The sound pressure gradient microphone according to claim 1, wherein the first high-pass filter further includes a first resistor having a grounded first end and a second end connected to a line between the first non-directional microphone and the subtractor, and the second high-pass filter further includes a second resistor having a grounded first end and a second end connected to a line between the second non-directional microphone and the delay device.

3. The sound pressure gradient microphone according to claim 1, wherein at least one of the first capacitor and the second capacitor is a variable capacitor.

4. A sound pressure gradient microphone, comprising:

a first non-directional microphone;

a second non-directional microphone;

a first high-pass filter that receives an output of the first non-directional microphone;

a second high-pass filter that receives an output of the second non-directional microphone;

a delay device that receives an output of the second high-pass filter; and a subtractor that receives an output of the first high-pass filter and an output of the delay device, and outputs a difference between the output of the first high-pass filter and the output of the delay device, wherein the first high-pass filter includes a first capacitor and a first resistor, the first capacitor is disposed between the first non-directional microphone and the subtractor and is connected in series to the first non-directional microphone and the subtractor, and the first resistor has a grounded first end and a second end connected to a line between the first non-directional microphone and the subtractor, the second high-pass filter includes a second capacitor and a second resistor, the second capacitor is disposed between the second non-directional microphone and the delay device and is connected in series to the second non-directional microphone and the delay device, and the second resistor has a grounded first end and a second end connected to a line between the second non-directional microphone and the delay device, and a resistance value of the first resister is smaller than a resistance value of the second resistor so as to achieve the state where a phase of a signal output from the first high-pass filter is ahead of a phase of a signal output from the second high-pass filter.

5. The sound pressure gradient microphone according to claim 4, wherein at least one of the first resistor and the second resistor is a variable resister.

* * * * *